US010526169B2

(12) United States Patent
Muller et al.

(10) Patent No.: US 10,526,169 B2
(45) Date of Patent: Jan. 7, 2020

(54) SAFETY SWITCHING FOR AN ELEVATOR SYSTEM

(71) Applicant: Inventio AG, Hergiswil (CH)

(72) Inventors: Rudolf J. Muller, Lucerne (CH); Eric Birrer, Buchrain (CH)

(73) Assignee: INVENTIO AG, Hergiswil NW (CH)

( * ) Notice: Subject to any disclaimer, the term of this patent is extended or adjusted under 35 U.S.C. 154(b) by 388 days.

(21) Appl. No.: 15/537,447

(22) PCT Filed: Nov. 13, 2015

(86) PCT No.: PCT/EP2015/076499

§ 371 (c)(1),
(2) Date: Jun. 19, 2017

(87) PCT Pub. No.: WO2016/096269

PCT Pub. Date: Jun. 23, 2016

(65) Prior Publication Data

US 2017/0341906 A1 Nov. 30, 2017

(30) Foreign Application Priority Data

Dec. 17, 2014 (EP) ..... 14198526

(51) Int. Cl.
*B66B 1/34* (2006.01)
*B66B 5/00* (2006.01)
(Continued)

(52) U.S. Cl.
CPC ..... *B66B 5/0093* (2013.01); *B66B 5/0031* (2013.01); *B66B 13/22* (2013.01); *B66B 19/007* (2013.01); *B66B 9/00* (2013.01)

(58) Field of Classification Search
CPC ..... B66B 5/0031; B66B 5/0093; B66B 9/00; B66B 13/22; B66B 19/007
(Continued)

(56) References Cited

U.S. PATENT DOCUMENTS 5,247,139 A 9/1993 Schon et al.
5,708,416 A * 1/1998 Zaharia ..... B66B 27/00 340/531
(Continued)

FOREIGN PATENT DOCUMENTS

CN 103370269 A 10/2013
WO 9218410 A1 10/1992
(Continued)

*Primary Examiner* — Anthony J Salata
(74) *Attorney, Agent, or Firm* — William J. Clemens; Shumaker, Loop & Kendrick, LLP

(57) ABSTRACT

A safety switching for elevator systems includes a safety function and a safety switch dedicated to the safety function. The safety switch opens or closes a safety circuit between one connection point and a second connection point as a function of a safety state of the safety function. A test function tests whether or not the safety switch opens and closes the safety circuit as a function of the safety state of the safety function. A detection device is provided for the test function. An auxiliary energy function is provided wherein an auxiliary voltage can be temporarily applied via at least the safety switch and an input part of the detection device for performing the test function. Locally between the connection points the auxiliary energy function introduces an auxiliary energy for generating the auxiliary voltage. The safety switching can be used for converting or retrofitting an existing elevator system.

15 Claims, 5 Drawing Sheets

(51) Int. Cl.
*B66B 13/22* (2006.01)
*B66B 19/00* (2006.01)
*B66B 9/00* (2006.01)

(58) Field of Classification Search
USPC ..... 187/247, 277, 316, 317, 391, 393, 394
See application file for complete search history.

(56) References Cited

U.S. PATENT DOCUMENTS 6,173,814 B1 * 1/2001 Herkel ..... B66B 1/34 187/248
6,193,019 B1 * 2/2001 Sirigu ..... B66B 13/22 187/391
6,446,760 B1 * 9/2002 Lisi ..... B66B 13/22 187/391
7,325,657 B2 * 2/2008 Angst ..... B66B 5/0018 187/247
7,334,665 B2 * 2/2008 Smith ..... B66B 1/34 187/247
7,575,102 B2 * 8/2009 Matsuoka ..... B66B 5/0093 187/391
8,552,738 B2 * 10/2013 Quinn ..... B66B 13/22 324/549
8,820,482 B2 * 9/2014 De Coi ..... B66B 5/0031 187/247
9,061,863 B2 * 6/2015 Birrer ..... B66B 13/22
10,012,696 B2 * 7/2018 Lustenberger ..... B66B 5/0031
10,239,729 B2 * 3/2019 Lustenberger ..... B66B 13/22
10,364,127 B2 * 7/2019 Muller ..... B66B 5/0093
2001/0035828 A1 11/2001 Rossignol

FOREIGN PATENT DOCUMENTS

WO 2011054674 A1 5/2011
WO 2014124779 A1 8/2014
WO 2016096269 A1 6/2016

* cited by examiner

A, B SAFETY FUNCTIONS
57 DETECTION DEVICE
61 RESISTOR
T TEST FUNCTION

SAFETY SWITCHING FOR AN ELEVATOR SYSTEM

FIELD

The invention relates to a safety switching for systems for conveying people and/or goods, in particular for elevator systems, the use of such a safety switching, an elevator system and a method which is performed with a safety switching.

BACKGROUND

A safety circuit in an elevator system and a method for monitoring semiconductor switches of an elevator system are known from WO 2011/054674 A1. A periodic measurement of the voltage or the current strength at the input and at the output of the semiconductor switches and, if the measurement revealed a short circuit, opening of the series connection of the safety circuit by means of a relay contact takes place with the known safety circuit and the known method. In other words, the elements of the electromechanical relay circuit of the known embodiment are used, in the case of a short circuit of the semiconductor switch, to open the safety circuit. The monitoring can take place here by means of a monitoring switching circuit which is processor-controlled. For the prevention or detection of a short circuit in a semiconductor switch, complicated and cost-intensive solutions can thus be avoided.

When use is made of a safety circuit, such as is known from WO 2011/054674 A1, the problem arises that the system must be in operation in order to carry out the check. If the energy supply is not available over a short or longer period at least in respect of the safety circuit, faults likewise cannot be detected. Such faults that have occurred in the meantime are then detected during or shortly after the re-establishment of the energy supply and then possibly lead to the elevator system having to be put out of operation for safety reasons. For the purpose of illustration, the following problem may for example arise. After the elevator system was temporarily put out of operation for the purpose of energy-saving, people enter the elevator car and select a target floor. When the elevator is intended to perform this travel command, the safety circuit is again energized. An emergency shutdown thus occurs when the elevator system is put back into operation or shortly thereafter if a corresponding defect has occurred during the stoppage of the elevator system and is now detected. In an unfavorable case, in which the fault is detected via the safety circuit only after the start of travel, people may get stuck in the elevator car.

A monitoring system for establishing a change in a switching position of a safety switch is known from WO2014/124779, wherein an energy supply device independent of the external energy supply is used in order to establish a change in a switching position of a safety switch even when the external energy supply is absent. It remains an open question here as to how such a monitoring system can be checked for correct functioning.

SUMMARY

A problem of the invention, therefore, is to provide a safety switching for systems for conveying people and/or goods, the use of at least one such safety switching, an elevator system with such a safety switching and a method which is carried out with such a safety switching, wherein improved functioning is achieved.

Solutions and proposals are given below, which solve at least parts of the problem posed. Moreover, advantageous additional or alternative developments and embodiments are given.

The safety switching is used for systems for conveying people and/or goods. The safety switching can be used in particular for a system constituted as an elevator system. Such a system has a safety function and a safety switch assigned to the safety function. This is not however to be understood as limiting. This is because a plurality of safety functions and accordingly a plurality of safety switches assigned to the safety functions can also be provided. The safety switch closes and opens a safety circuit between a connection point and at least one further connection point of the safety switching as a function of a safety state of the safety function. A plurality of such safety switchings can be provided for the elevator system, which safety switchings are optionally integrated also in combination with standard safety switchings into the safety circuit. A safety circuit can thus be formed, which comprises at least one safety switching. The integration of the safety switching into the safety circuit takes place at its connection points. The safety switching has a test function which is provided for testing the safety function. During a test, the test function tests whether the safety switch opens and closes the safety circuit as a function of the safety state of the safety function. A plurality of safety switches corresponding to a plurality of safety functions of a safety switching can also be tested jointly via the test function. To test whether the safety switch can open and close the safety circuit as a function of the safety state of the safety function, the test function opens and closes the safety switch to be tested.

As a rule, both the correct function of the opening and the closing are checked. It is however essential that the safety switch at least opens the safety circuit as a function of the safety state of the safety function. Immediate safety of the system is thus guaranteed.

A detection device is provided for the test function. In a possible embodiment, the test signal received from an output part of the detection device can be evaluated via an integrated switching circuit which comprises a suitable number of inputs and outputs. Furthermore, an auxiliary energy function can be provided, with which an auxiliary voltage can be applied, preferably temporarily, via at least one safety switch and an input part of the detection device in order to perform the test function. This auxiliary voltage can also be applied via a plurality of safety switches, which are preferably connected in series. Locally between the connection and the at least one further connection point in the safety circuit, the auxiliary energy function introduces auxiliary energy for the purpose of generating the auxiliary voltage. The check of the at least one safety switch of the safety switching can thus be carried out independently of other, possibly conventionally constituted safety monitoring of the safety circuit. A low energy requirement then arises for the check. The check by means of the safety switching is preferably limited to a period in which the system is out of operation. This is because, when the system is in operation, the check can then take place completely via the safety circuit, when in particular no auxiliary energy function is required.

The safety switching preferably comprises a control unit which, on the one hand for the purpose of testing the safety switches, opens and closes the latter by means of the test function and which furthermore evaluates and checks the test signal received from the detection device in conjunction with the test function. During a test, the control unit thus checks whether the safety switch can open and close the safety circuit as a function of the safety state of the safety function. For this purpose, the test function opens and closes the safety switch preferably by means of the safety function and the detection device detects the resultant opening and/or closing of the safety circuit. Test function, detection device and control unit can be split up into individual assemblies, but preferably they are combined into a common assembly.

The safety switching can advantageously be used for converting or retrofitting an existing elevator system. A use of at least one safety switching according to the invention thus arises for the conversion or retrofitting of an existing elevator system. If a plurality of safety switchings according to the invention are used in such a conversion or retrofitting, they can be constituted identically or differently depending on the application. This is because the safety switchings can advantageously operate autonomously by themselves and can thus be selected with regard to the given point of use on the elevator system. This also relates to the possibility of testing one or more safety functions with one safety switch or a plurality of safety switches at the given point of use. The safety switching can be used in particular in a corresponding embodiment for monitoring conventional safety monitoring systems.

In the case of such a use, the at least one safety switching can advantageously be used for converting or retrofitting an existing safety circuit of the elevator car. In an advantageous way, it is possible here for a mechanical safety switch to be replaced by an electronic safety switch in the course of the conversion or retrofitting. Especially in the case of commercially used buildings, much higher switching cycles can thus be permitted, which has a favorable effect on maintenance and replacement intervals.

Furthermore, an elevator system with an elevator car, a travel space provided for the travel of the elevator car and a plurality of shaft doors can be produced, wherein at least one safety circuit is provided for monitoring the elevator car and/or the shaft doors. This elevator system is then produced with at least one safety switching according to the invention on the safety circuit. This elevator system is particularly well suited for commercially used buildings, high visitor numbers or for otherwise occurring frequent use.

With the safety switching according to the invention, moreover, a method for testing at least one safety function in systems for conveying people and/or goods can be carried out, wherein the testing of the at least one safety function takes place by means of the safety switching at certain test timeslots during a period in which the system is out of operation. The test timeslots can advantageously be repeated periodically. The repetition preferably takes place with a gap of more than 10 seconds. The test timeslot can last for example for 5 milliseconds and can be repeated every 5 seconds.

The auxiliary energy can advantageously be introduced into the safety circuit over the test timeslot. Opening of the safety switch can be brought about via the test function and the opening of the safety circuit can be detected via the detection device. Before and/or after the opening, closing of the safety switch is advantageously brought about via the test function and closing of the safety circuit is detected via the detection device. The test can take place with a small voltage, for example of 1.4 V. A power of for example less than 30 milliwatt (mW) can thus suffice, which for the overall energy consumption is negligible.

The output part of the detection device and the input part of the detection device are advantageously separated from one another galvanically. For this purpose, the detection device can for example comprise an optocoupler, wherein the input part of the detection device comprises a radiation transmitter of the optocoupler and wherein the output part of the detection device comprises a radiation receiver of the optocoupler. Particularly in this connection, it is also advantageous that the auxiliary energy function introduces the auxiliary energy into the safety circuit locally by means of electromagnetic induction between the connection point and the at least one further connection point. An electrical separation, in particular a galvanic isolation, is thus possible between a side of the safety switching which initiates and performs the test and the other side of the safety switching which is integrated into the safety circuit.

Alternatively, other detection devices are also possible. Instead of the optocoupler, a magnetic coupling can also take place, wherein the input part of the detection device comprises a coil for example and wherein the output part of the detection device comprises a magnetic field detector, such as for example a further coil or a Hall sensor.

It is also advantageous that an isolating transformer is provided for the auxiliary energy function and that an output winding of the isolating transformer is connected in series with the safety switch between the connection point and the at least one further connection point. The input winding of the isolating transformer can be connected for example to an integrated switching circuit.

In an advantageous variant of the embodiment, the detection device is integrated into the control of the isolating transformer or in the latter itself. Advantage can thus be taken of two different effects.

When use is made of a first effect, a pulse is introduced to a primary side of the isolating transformer and the corresponding reflection is awaited. This only occurs if the current can flow on the secondary side, i.e. if the safety switch is closed. Consequently, if no reflection can be detected or measured, the safety switch is in fact open. Opening of the safety switch accordingly brings about the absence of the reflection.

When use is made of the second effect, a pulse, a pulse sequence or an AC signal is introduced on the primary side and the current or the inductance of the primary coil is measured. A higher current, or a smaller inductance, shows that current can flow in the secondary side and the safety switch is closed. On the other hand, a small current, or a larger inductance, shows that no current is flowing in the secondary side and the safety switch is therefore opened.

From a comparison of the state with an opened and closed safety switch, it is thus possible to check whether the safety switch has actually opened.

It is advantageous here that directional diodes are provided, which enable a closed current circuit via the output winding of the isolating transformer and the safety switch inside a sub-circuit between the connection point and the at least one further connection point. In this regard, the safety circuit can be interrogated via a direct voltage signal, which is present proportionally between the connection point and the at least one further connection point in such a way that the directional diodes are orientated in the reverse direction. The auxiliary voltage, on the other hand, preferably has an alternating current component, as a result of which the closed current circuit results via the directional diodes.

Furthermore, it is advantageous that an isolating transformer is provided for the auxiliary energy function, that an output winding of the isolating transformer is arranged in a sub-circuit, which is provided between the connection point and the at least one further connection point, and that the isolating transformer is excluded, by at least one capacitor of the sub-circuit, from the direct current path between the connection point and the at least one further connection point. In this embodiment, in the case of interrogation of the safety circuit via a direct voltage, the direct current arising in response to the interrogation is conducted via a direct current path, from which the isolating transformer is excluded. Possible influences of the isolating transformer, which can occur in particular with a possible steep switch-on edge of the direct voltage signal, are thus prevented.

It is advantageous that the safety function is used for checking a retardation before a final stopping point is reached or for checking a correctly closed car door for travel of the elevator car. Special safety functions for checking a correct deceleration before a final stopping point is reached are as a rule never switched. To check the correct switching-off, the safety functions or the assigned preferably electronic safety switches can be tested with the safety switching.

Critical parts of the safety circuit or a semiconductor component or solid-state component (SSD) can thus be supplied with a small galvanically isolated voltage signal and the correct function of the at least one safety switch can thus be tested at all times. This approach to a solution is particularly interesting when existing elevator systems are retrofitted in the course of modernization with new, modern components, which include for example electronic switching devices, in particular semiconductor components or solid-state components. High switching cycles can thus be achieved. It is therefore advantageous that the safety switch is constituted as an electronic safety switch.

It is also advantageous that a plurality of safety functions are provided, that a plurality of safety switches are provided for the plurality of safety functions, that the control unit is provided with a test function and detection device for testing the safety functions, which tests whether the safety switches open and close the safety circuit as a function of the safety states of the safety functions, and that the auxiliary voltage can be applied via the safety switches and the input part of the detection device. A plurality of safety functions, which are preferably implemented locally together, can thus be checked locally with regard to the mode of functioning of their safety switches, when for example the elevator system is out of operation.

An unexpected shutdown the elevator system can thus be prevented or the elevator system can, even before a passenger gives a travel command, be put out of operation. Fault-related shutdowns during operation of the elevator system or after a passenger has already given the travel command can thus be reduced. A small energy requirement thus results, since the testing can take place with a small signal current and the associated test voltage only has to be applied briefly.

It is thus possible, with a stationary elevator system when no travel command is pre-sent, for the safety circuit to be de-energized in order to save energy, and yet a fault can be detected. In such a state, as in the case of a stationary elevator system, the possibly occurring fault can thus be detected in good time and not just when the elevator is about to execute a travel command and the safety circuit present during operation is thus duly re-energized. Emergency shutdowns with a correspondingly unfavorable effect on any passengers who are already in the elevator are thus prevented.

DESCRIPTION OF THE DRAWINGS

Preferred examples of embodiment of the invention are explained in greater detail in the following description with the aid of the appended drawings, in which corresponding elements are provided with corresponding reference numbers. In the figures.

DETAILED DESCRIPTION

Figure 1:
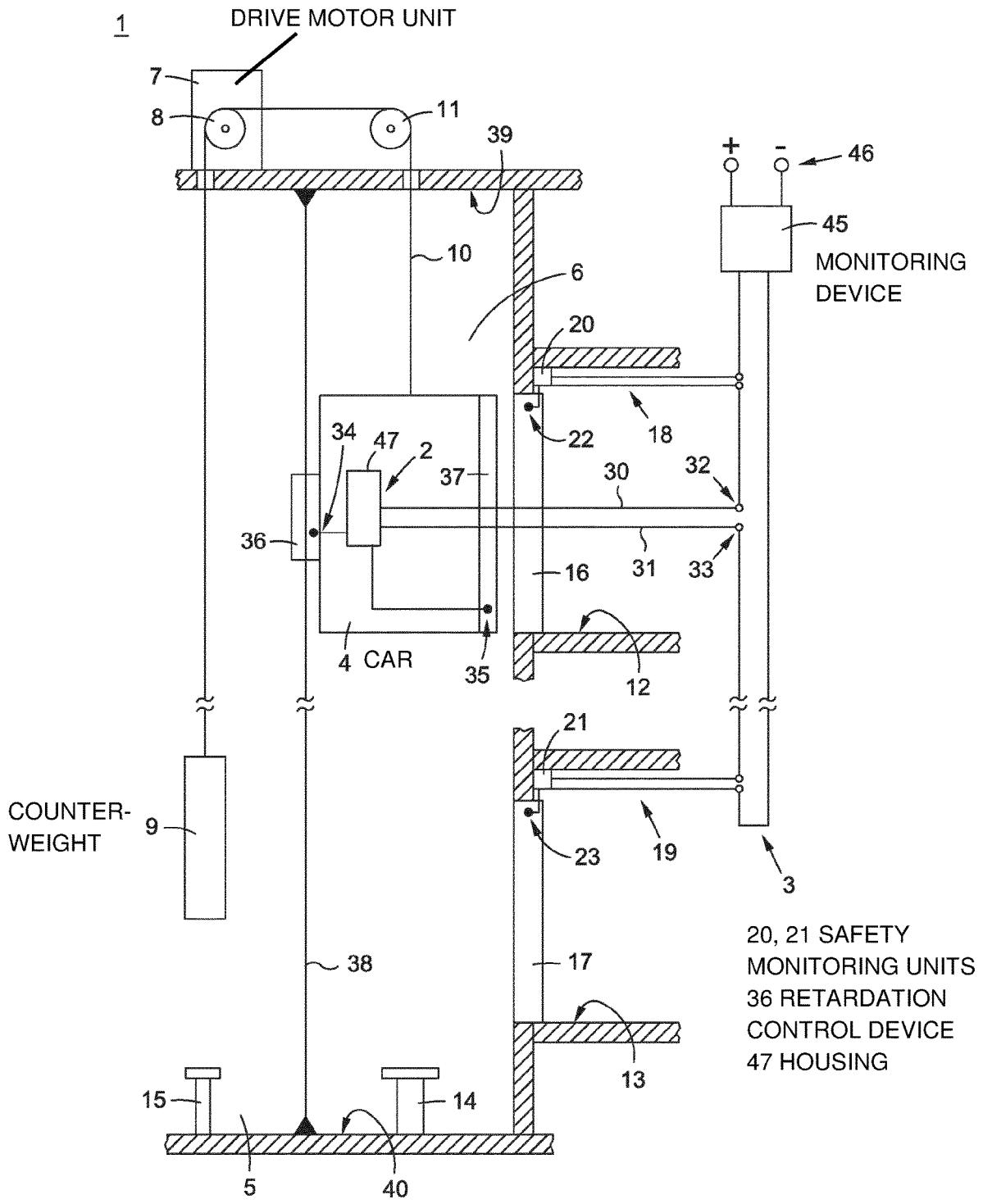
FIG. 1 shows an elevator system with a safety switching on a safety circuit in a partial diagrammatic representation corresponding to a possible embodiment of the invention.

FIG. 1 shows an elevator system 1 with a safety switching 2 on a safety circuit 3 in a partial diagrammatic representation corresponding to a possible embodiment of the invention. Elevator system 1 is a preferred embodiment of a system 1 for conveying people and/or goods. Elevator system 1 comprises an elevator car 4 and an elevator shaft 5. Elevator car 4 can be moved in a travel space 6 provided for the travel of elevator car 4. Travel space 6 is part of elevator shaft 5. Safety switching 2 is particularly well suited for such an elevator system 1.

Furthermore, elevator system 1 comprises a drive motor unit 7 with a drive pulley 8 and a counterweight 9. Elevator car 4 is suspended on a traction means 10, which at the same time serves as a support means 10. Traction means 10 is passed around a deflection pulley 11 and around drive pulley 8. Furthermore, traction means 10 is connected to counterweight 9.

For the sake of simplified representation, only a top floor 12 and a bottom floor 13 are represented in FIG. 1. Buffers 14, 15 are arranged in elevator shaft 5 in the region of bottom floor 13, against which buffers elevator car 4 or counterweight 9 collide in the event of a malfunction. A floor door 16 is provided at floor 12. A floor door 17 is provided at floor 13.

Safety circuit 3 is represented essentially with regard to its electrical connections. A safety monitoring unit 20 and a safety monitoring unit 21 are integrated via electrical lines 18 and via electrical lines 19 into safety circuit 3. A safety switch 22 is provided for safety monitoring unit 20, which monitors floor door 16. A safety switch 23 is provided for safety monitoring unit 21, which monitors floor door 17. Safety monitoring units 20, 21 can be designed conventionally. Safety switches 22, 23 can be mechanical safety switches 22, 23.

Safety switching 2, on the other hand, is constituted corresponding to a possible example of embodiment of the invention. A first example of a possible embodiment of safety switching 2 is described in greater detail with the aid of FIG. 2. A second example of a possible embodiment of safety switching 2 is described in greater detail with the aid FIG. 4.

Safety switching 2 represented in FIG. 1 is integrated into safety circuit 3 via an electrical line 30 and an electrical line 31. A first connection 32 and a second connection 33 are illustrated here, at which the electrical connection to the rest of safety circuit 3 takes place. Electrical lines 30, 31 are represented in FIG. 1 in a simplified form with regard to their electrical function. To provide the electrical connection, suitable cables can be provided, which are suspended in elevator shaft 5, so that elevator car 4 can be traversed through travel space 6 while the electrical connection to safety circuit 3 remains in place. Such electrical lines suspended in elevator shaft 5 can be a component part of electrical lines 30, 31 or can also be assembled as separate, additional electrical connection elements. Other possible options are however also conceivable for integrating safety switching 2 into safety circuit 3. Furthermore, in a modified embodiment, it is possible for more than one safety circuit 3 to be provided. In particular, stationary devices, such as floor doors 16, 17, can thus be monitored via stationary safety monitoring units 20, 21, which are incorporated into a separate safety circuit.

Safety switching 2 comprises a first safety switch 34 and a second safety switch 35. First safety switch 34 is used for a retardation control device 36. Second safety switch 35 is used to monitor elevator car door 37. These applications of safety switches 34, 35 represent possible applications for implementing safety functions on elevator car 4. One or more safety functions of safety switching 2 can be implemented in this or another way.

Retardation control device 36 is arranged on elevator car 4. Retardation control device 36 can also be retrofitted on an existing elevator car 4. Retardation control device 36 cooperates with a measuring tape 38, on which codes are provided. Retardation control device 36 detects the current position of elevator car 4 in travel space 6 from the codes provided on measuring tape 38. In particular, a distance from a ceiling 39 or from a floor 40 of elevator shaft 5 can thus be determined. In a modified embodiment, such a retardation control device 36 can also be based on another principle. For example, retardation control device 36 can employ the principle of a radar using electromagnetic radiation, for example to detect the distance from ceiling 39 and/or from floor 40.

Retardation control device 36 can monitor, particularly in the region of top floor 12 and bottom floor 13, the reliable braking of elevator car 4. A safety function is thus implemented, which prevents a collision with ceiling 39 or a violent crash of elevator car 4 at buffer 14 and/or of counterweight 9 at buffer 15. For this purpose, retardation control device 36 actuates first safety switch 34 if the retardation is too small. When the first safety switch is actuated and thus opened, an emergency stop is triggered during normal operation by safety circuit 3.

Second safety switch 35 is correspondingly actuated when elevator car door 37 is opened. If elevator car 4 stops at one of floors 12, 13, second safety switch 35 can then be bridged. If, however, elevator car 4 is moving through travel space 6, an emergency stop is triggered by safety circuit 3 when second safety switch 35 is opened.

Operation of elevator system 1 is understood here to mean that a main energy supply is present to an extent such that a device 45 of safety circuit 3 monitors the opening of one of safety switches 22, 23, 34, 35 or can check the proper functioning of a safety switch 22, 23, 34, 35. During the operation of elevator system 1, a direct voltage 46 is applied to safety circuit 3 and a check is made to establish whether a current connection arises. The application of direct voltage 46 can take place repeatedly within a certain time interval and thus only for a short test period.

When elevator system 1 is put out of operation, it means here that device 45 is de-energized at least to an extent such that a possible opening of a safety switch 22, 23, 34, 35 cannot be detected.

When elevator system 1 is thus put out of operation, possibly occurring safety functions cannot be tested by device 45 of safety circuit 3. However, such a test is possible locally via safety switching 2 corresponding to the examples of embodiment of the invention. This enablement of the testing is represented here by way of example with the aid of safety switching 2. Safety monitoring units 20, 21 are regarded here as conventional safety monitoring units 20, 21, which can be tested only by device 45. It goes without saying, however, that the operating principle of safety switching 2, which enables a local check, can also be implemented in a corresponding way on other safety monitoring units of elevator system 1, in particular on safety monitoring units 20, 21. Depending on the application, differently constituted safety switchings 2 can be employed at the given point of use.

In this example of embodiment, safety switching 2 is partially accommodated in a housing 47. Other components, in particular an elevator control, can also be accommodated in housing 47. Safety switching 2 can also be partially integrated into the elevator control.

Figure 2:
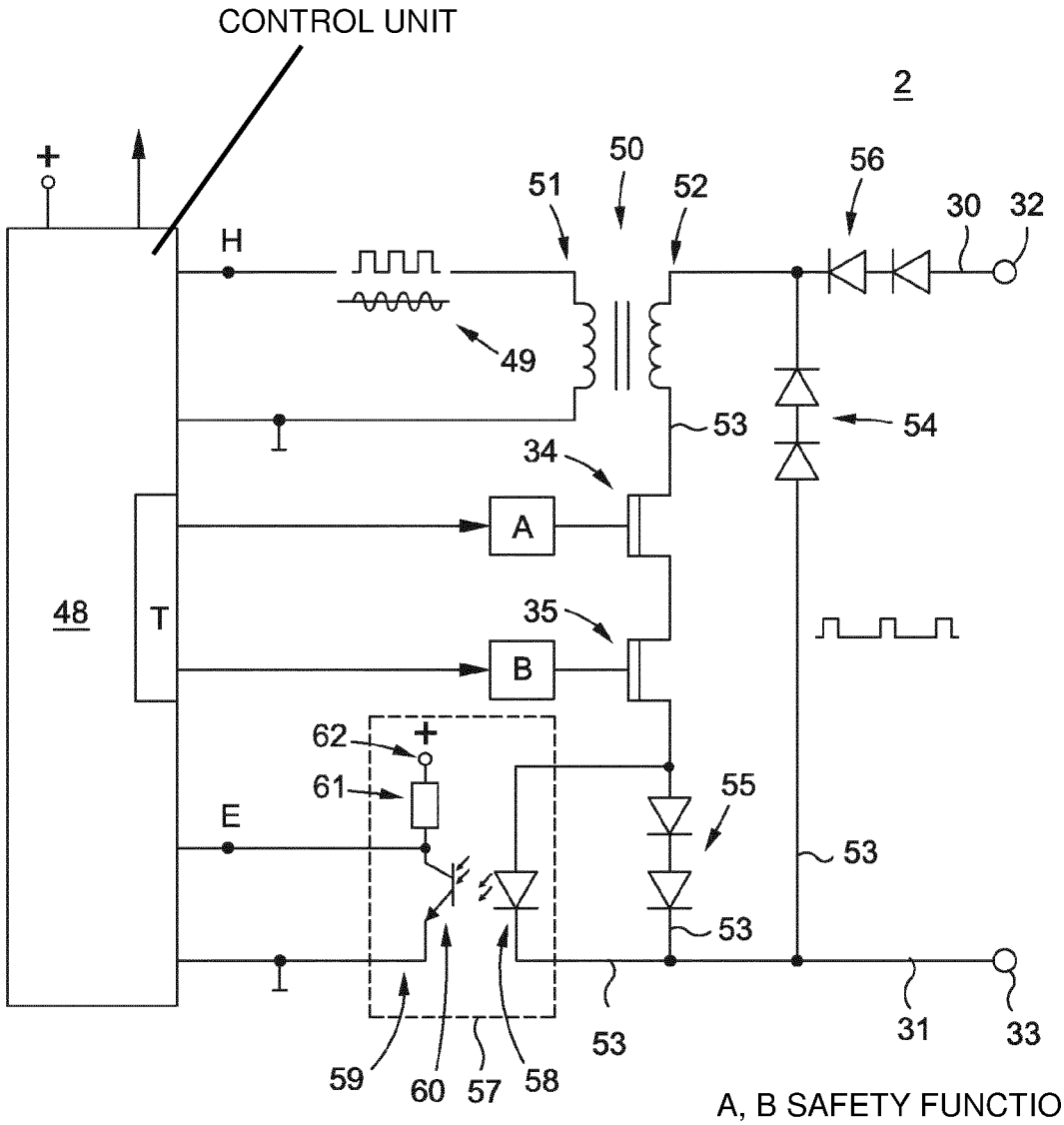
FIG. 2 shows a safety switching for the elevator system represented in FIG. 1 corresponding to a first example of embodiment of the invention.

FIG. 2 shows a safety switching 2 for elevator system 1 represented in FIG. 1 corresponding to a first example of embodiment of the invention. Safety switching 2 comprises a control unit 48, which can be implemented by an integrated circuit 48. An auxiliary energy function H can be activated via a control unit 48. When auxiliary energy function H is activated, an auxiliary signal 49 is generated with or without a direct voltage component and an alternating current component of a suitable waveform. Auxiliary signal 49 can for example be constituted as a rectangular signal or a sinusoidal signal. Safety switching 2 also comprises an isolating transformer 50 with an input winding 51 and an output winding 52. Auxiliary signal 49 is conveyed via input winding 51. An auxiliary voltage is as induced in output winding 52.

Safety functions A, B are implemented in this example of embodiment. In a modified embodiment, just one safety function A can be implemented. Furthermore, more than two safety functions A, B can be implemented. Each of safety functions A, B is assigned to a safety switch 34, 35. In this example of embodiment, first safety switch 34 is provided for retardation control device 36. And second safety switch 35 is provided for elevator car door 37. The number of safety switches 34, 35 usually agrees with the number of safety functions A, B.

When safety switches 34, 35 are closed, a current flow in a sub-circuit 53 of safety switching 2 is produced via the induced auxiliary voltage. Sub-circuit 53 is located completely inside the region between connections 32, 33. A local current flow thus arises. At least one directional diode 54 and at least one directional diode 55 are arranged in sub-circuit 53. Moreover, at least one directional diode 56 is also arranged in electrical line 30, which however is located outside sub-circuit 53. The at least one directional diode 56 is namely provided for the check by means of device 45, wherein however it is now assumed that elevator system 1, as defined above, is out of operation.

As a result of the switching, a voltage drop at the at least one directional diode 55 occurs with closed safety switches 34, 35. In this example of embodiment, the voltage drop results from the threshold voltage or the sum of the threshold voltages of the at least one directional diode 55, when the at least one directional diode 55 is actuated into the forward direction.

Furthermore, a detection device 57 is provided with an input part 58 and an output part 59. Input 58 comprises a photodiode 58, which is operated with the voltage drop at the at least one directional diode 55. A phototransistor 60 is assigned to photodiode 58. Phototransistor 60 is actuated at its base via photodiode 58 and supplied via resistor 61 from a voltage source 62. When phototransistor 60 is switched into the forward direction as a result of the actuation via photodiode 58, an input signal E is switched to earth. When, on the other hand, phototransistor 60 is blocking, input signal E lies on the positive voltage of voltage source 62.

In this example of embodiment, an optocoupler 58, 60 is implemented via photodiode 58 and phototransistor 60. A photodiode 58 is an example of embodiment of a radiation transmitter 58 of optocoupler 58, 60. Phototransistor 60 is a possible embodiment of a radiation receiver 60 of optocoupler 58, 60. A galvanic isolation between input part 58 and output part 59 is brought about by optocoupler 58, 60.

A galvanic isolation between input winding 51 and output winding 52 correspondingly results via isolating transformer 50. The earth on the side of control unit 48 is independent of a possible earth of safety circuit 3 on the side of connections 32, 33.

The auxiliary energy, which is introduced by auxiliary energy function H into safety circuit 3 locally between connection point 32 and the at least one further connection point 33 to generate the auxiliary voltage in sub-circuit 53, is thus introduced locally by means of electromagnetic induction. The feedback also takes place locally and by way of a galvanic isolation.

For the testing of safety functions A, B, control unit 48 comprises a test function T. Detection device 57 is provided locally for test function T. The evaluation takes place by control unit 48. A possible embodiment of a method for testing safety functions A, B is described in greater detail with the aid of FIG. 5.

Figure 3:
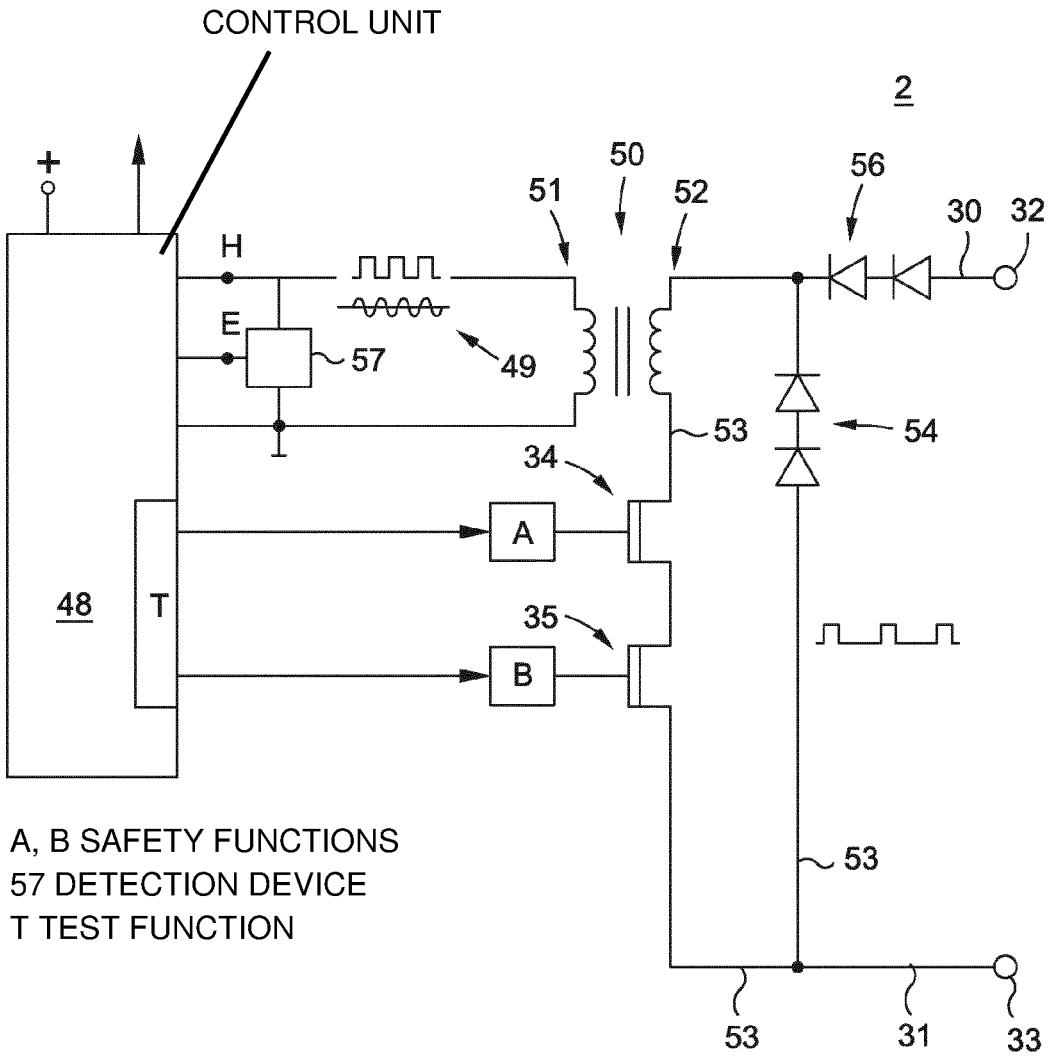
FIG. 3 shows a safety switching for the elevator system represented in FIG. 1 corresponding to a modified first example of embodiment of the invention.

FIG. 3 shows a safety switching for the elevator system represented in FIG. 1 corresponding to a modified example of embodiment of the invention. The design of safety switching 2 differs from the embodiment described in FIG. 2 in that detection device 57 is arranged in the primary circuit of auxiliary energy function H or its isolating transformer 50. In a variant of embodiment, a first effect is used. A pulse is introduced in the primary circuit of isolating transformer 50 and a corresponding reflection is awaited. This only occurs if current can flow on the secondary side, i.e. if safety switch 34, 35 is closed. Consequently, if no reflection can be detected or measured, safety switch 34, 35 is in fact opened. Opening of safety switch 34, 35 accordingly brings about an absence of the reflection. The control and evaluation of the pulse sequence and the reflection takes place once again by control unit 48. In an alternative variant of embodiment, another effect is used. A pulse, a pulse sequence or an AC signal is introduced on the primary side of isolating transformer 50 and a current or an inductance of the primary coil is measured. A higher current, or a smaller inductance, shows that current can flow in the secondary side and the safety switch is closed. On the other hand, a smaller current, or a greater inductance, shows that no current is flowing in the secondary side and consequently the safety switch is opened. Control unit 48 controls the pulse sequence and compares the state with an opened and closed safety switch 34, 35 with one another and thus tests the extent to which safety switch 34, 35 has actually opened.

Figure 4:
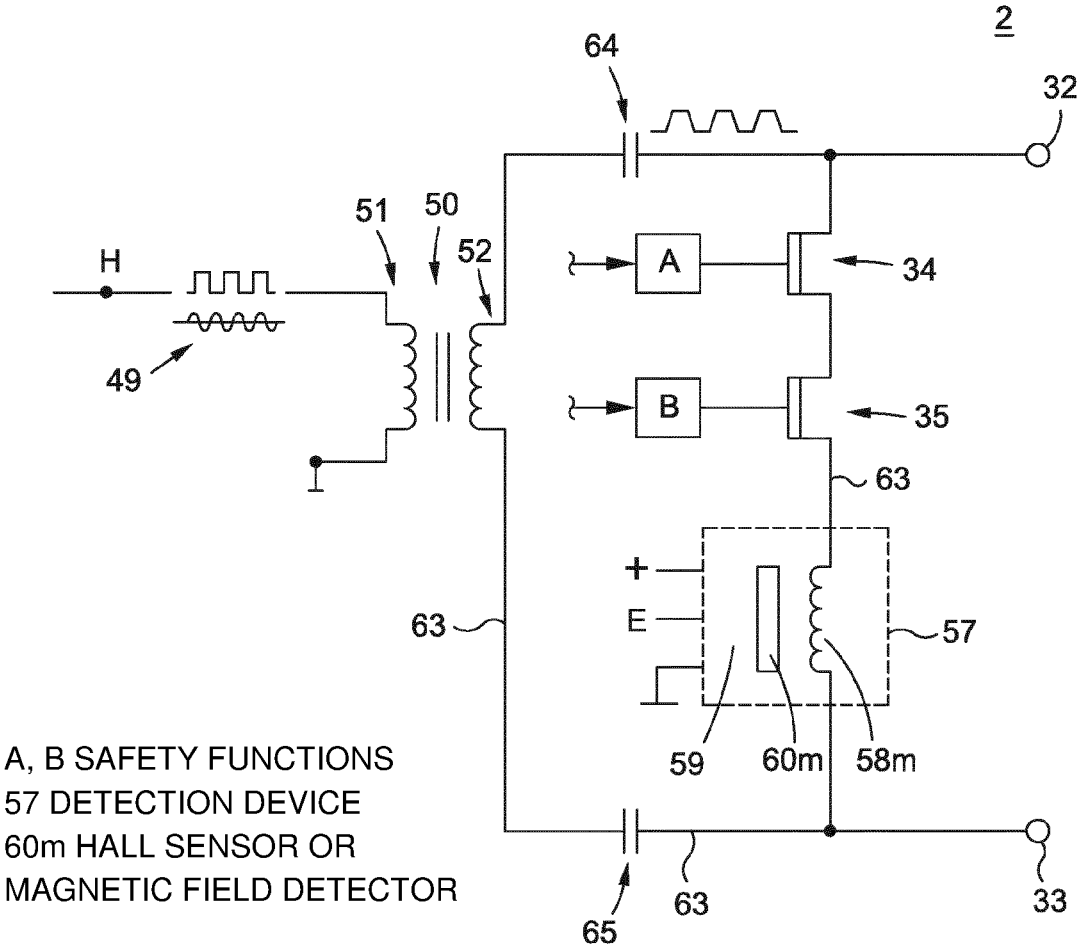
FIG. 4 shows a safety switching for the elevator system represented in FIG. 1 corresponding to a second example of embodiment of the invention.

FIG. 4 shows a safety switching 2 for elevator system 1 represented in FIG. 1 corresponding to a further example of embodiment of the invention.

In this example of embodiment, the auxiliary voltage is induced in a sub-circuit 63 between connection point 32 and the at least one further connection point 33. In the first example of embodiment described with the aid of FIG. 2, output winding 52 of isolating transformer 50 is located between connections 32, 33 in a series connection with safety switches 34, 35 and the at least one directional diode 55. In the second example of embodiment described with the aid of FIG. 4, however, an isolation is provided via at least one capacitor 64, 65. This means that the test taking place via safety circuit 3 pursues the current path not via output winding 52 during operation of elevator system 1. In this example of embodiment, isolating transformer 50 is thus excluded by capacitors 64, 65 from a direct current path between connection point 32 and the at least one further connection point 33.

Detection device 57, as explained in connection with FIG. 2, is provided with an input part 58 and an output part 59. In contrast with the embodiment of FIG. 2, input part **58*m* comprises a coil form 58*m* which is directly integrated into sub-circuit 63. A Hall sensor or a magnetic field detector 60*m* is arranged in the coil form. Magnetic field detector 60*m* is used to test the interruption of the current circuit and therefore a correct opening of safety switches 34, 35 of safety functions A, B. This represents an alternative to the optocoupler according to FIG. 2. These two principles are essentially interchangeable. To simplify the representation, control unit 48** is likewise not shown.

Figure 5:
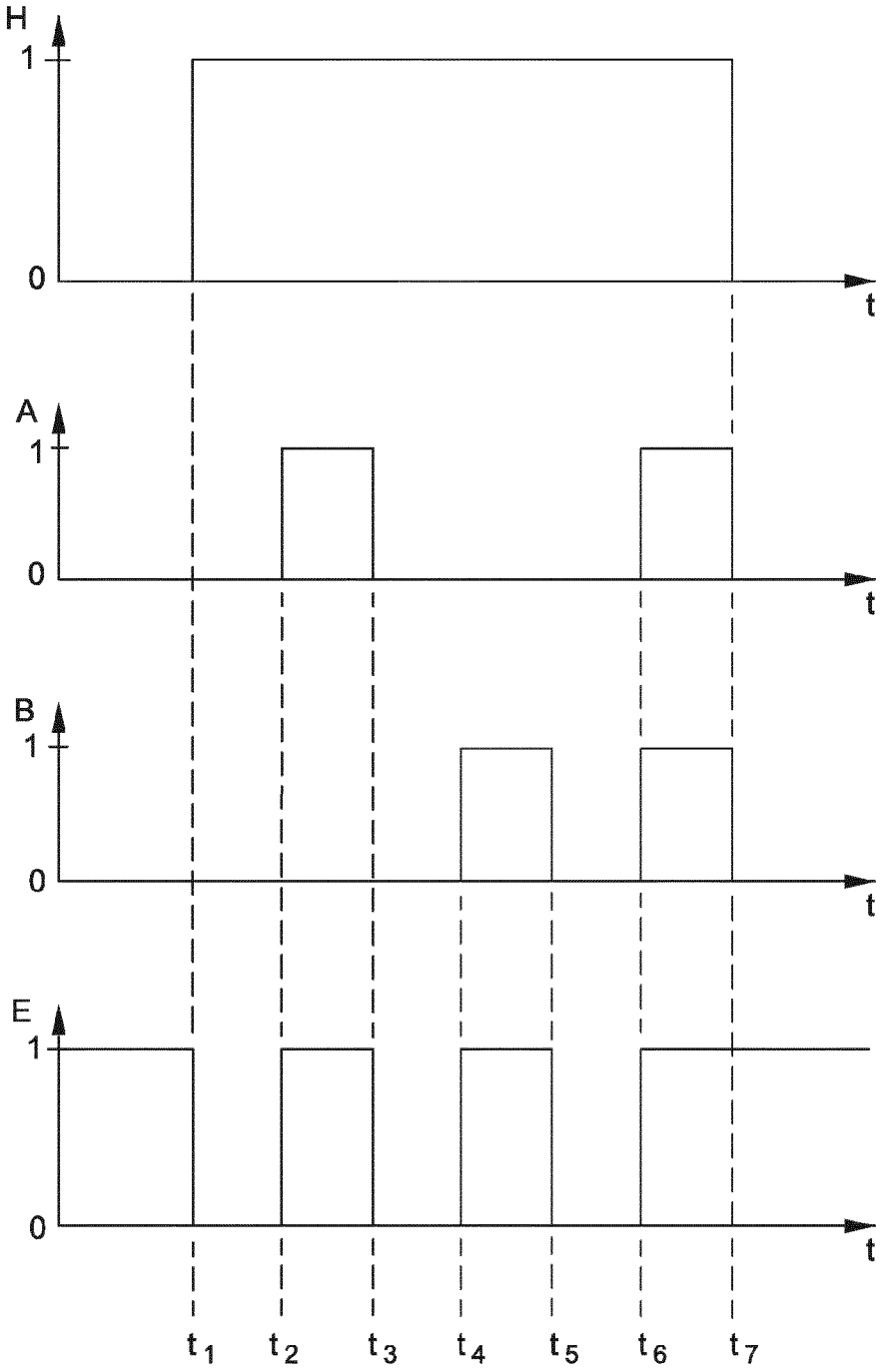
FIG. 5 shows a signal flowchart to explain the mode of functioning of a possible embodiment of a safety switching of the invention.

FIG. 5 shows a signal diagram to explain the mode of functioning of a possible embodiment of safety switching 2 of the invention. In a method for testing safety functions A, B, such tests can be repeated at a certain time intervals. To simplify the representation, auxiliary energy functions H, safety functions A, B and input signal E, which are plotted on the ordinate, are illustrated coded in a binary manner. Time t is plotted on the abscissa.

It is assumed here that voltage source 62 is permanently switched on. In a modified embodiment, voltage source 62 can however also be switched off temporarily between the test procedures. Auxiliary energy function H is not required until point in time $t_1$. Since no auxiliary energy is introduced into safety circuit 3, photodiode 58 remains de-energized, so that phototransistor 60 is blocking. Input signal E is therefore set to 1 corresponding to voltage source 62. At point in time $t_1$, auxiliary energy function H is required and is therefore set to 1 in this signal diagram. Test function T, however, activates neither of safety functions A, B between points in time $t_1$ and $t_2$. Safety switches 34, 35 therefore remain closed. As a result of the introduction of the auxiliary energy, an auxiliary voltage arises which activates optocoupler 58, 60 via the voltage drop at the at least one directional diode 55. Phototransistor 60 thus switches to earth, so that input signal E is set to 0.

For the test, safety function A is activated between point in time $t_2$ and point in time $t_3$. Opening of first safety switch 34 thereby takes place. This signifies an interruption of the current flow at input part 58. Input signal E is accordingly set to 1.

Safety function A is again deactivated between points in time $t_3$ and $t_4$, so that the same situation as between points in time $t_1$ and $t_2$ results.

Safety function B is activated between points in time $t_4$ and $t_5$, so that in this case second safety switch 35 interrupts the current flow through photodiode 58. Input signal E is thus again set to 1.

Safety functions A, B are not activated between points in time $t_5$ and $t_6$, so that optocoupler 58, 60 is active and input signal E is switched to earth. Input signal E is therefore 0.

A simultaneous activation of safety functions A, B can then optionally take place. This is represented here between points in time $t_6$ and $t_7$. Here, the current flow through input part 58 is again interrupted, so that input signal E is set to 1. Auxiliary energy function H is deactivated at point in time $t_7$.

From the described signal diagram, control unit 48 determines that safety functions A, B are operating reliably. Control unit 48 can deduce from a deviation from the described signal diagram that a fault is present. A small energy requirement arises here, since the energy supply for performing the method has to be consumed for the testing in each case only for short time intervals (test timeslots) between points in time $t_1$ and $t_7$. An associated test cycle (test timeslot) can amount for example to 5 milliseconds and can be repeated every 5 seconds. Since the test can take place with a small alternating voltage of for example 1.4 V, a negligible power results, which can be less than 30 milliwatts. A reliable test with low energy consumption can thus take place by the temporary application of the auxiliary voltage via safety switches 34, 35 and input part 58 of detection device 57.

Local monitoring of safety switching 2 can thus be carried out during a stoppage of elevator system 1 in which safety circuit 3 is out of operation. If for example a building is not opened overnight or between work days and a fault occurs in this period, this can be detected in good time in a test. A test is in particular carried out to establish whether safety switches 34, 35 open and close the safety circuit as a function of the safety state of safety functions A, B. If one of safety switches 34, 35 fails, this failure is then detected for example by way of the described test cycle. A service engineer can then remove the fault in good time.

The invention is not limited to the described examples of embodiment and modifications.

In accordance with the provisions of the patent statutes, the present invention has been described in what is considered to represent its preferred embodiment. However, it should be noted that the invention can be practiced otherwise than as specifically illustrated and described without departing from its spirit or scope.

The invention claimed is:

1. A safety switching for an elevator system having a safety function, a safety switch assigned to the safety function, the safety switch opening and closing a safety circuit between a first connection point and a second connection point as a function of a safety state of the safety function, a test function for testing the safety function by testing whether the safety switch can open and close the safety circuit as a function of the safety state of the safety function, wherein the test function opens and closes the safety switch, comprising:

a detection device for the test function;

an auxiliary energy function for applying an auxiliary voltage, at least temporarily, via the safety switch and an input part of the detection device to enable performance of the test function; and wherein between the first connection point and the second connection point the auxiliary energy function introduces into the safety circuit auxiliary energy to generate the auxiliary voltage.

2. The safety switching according to claim 1 including a control unit that triggers the test function and evaluates a test signal received from the detection device, the test signal being associated with the test function.

3. The safety switching according to claim 1 wherein the auxiliary energy function introduces the auxiliary energy into the safety circuit locally by electromagnetic induction between the first connection point and the second connection point.

4. The safety switching according to claim 1 including an isolating transformer associated with the auxiliary energy function, wherein an output winding of the isolating transformer is connected in series with the safety switch between the first connection point and the second connection point.

5. The safety switching according to claim 4 including directional diodes forming a closed current circuit with the output winding of the isolating transformer and the safety switch inside a sub-circuit between the first connection point and the second connection point.

6. The safety switching according to claim 1 including an isolating transformer associated with the auxiliary energy function, wherein an output winding of the isolating transformer is arranged in a sub-circuit between the first connection point and the second connection point, and wherein the isolating transformer is excluded, by at least one capacitor of the sub-circuit, from a direct current path between the first connection point and the second connection point.

7. The safety switching according to claim 1 wherein the detection device has an output part and the input part of the detection device and the output part of the detection device are galvanically separated from one another.

8. The safety switching according to claim 7 wherein the detection device includes an optocoupler, wherein the input part of the detection device is a radiation transmitter of the optocoupler and the output part of the detection device is a radiation receiver of the optocoupler.

9. The safety switching according to claim 7 wherein the detection device includes a magnetic coupler, wherein the input part of the detection device is a coil form of the magnetic coupler and the output part of the detection device is a magnetic field detector of the magnetic coupler.

10. The safety switching according to claim 1 including an isolating transformer associated with the auxiliary energy function, wherein an output winding of the isolating transformer is connected in series with the safety switch between the first connection point and the second connection point, and wherein the detection device detects an induced current in an input winding of the isolating transformer or in the output winding.

11. The safety switching according to claim 1 wherein the safety function checks a correct retardation of an elevator car before a final stopping point is reached or checks for a correctly closed elevator car door for travel of the elevator car.

12. The safety switching according to claim 1 including a plurality of safety functions, a plurality of safety switches for the plurality of safety functions, wherein the test function tests the safety functions to determine whether the safety switches open and close the safety circuit as a function of the safety states of the safety functions, and wherein the auxiliary voltage is applied via the safety switches and the input part of the detection device.

13. A method for converting or retrofitting an existing elevator system by adding at least one of the safety switching according to claim 1.

14. An elevator system having an elevator car, a travel space provided for travel of the elevator car and a plurality of floor doors, wherein at least one safety circuit monitors at least one of the elevator car and the floor doors, and including at least one of the safety switching according to claim 1 connected to the at least one safety circuit.

15. A method for testing at least one safety function of a safety circuit in a system for conveying people and/or goods, the testing being performed with the safety switching according to claim 1, comprising the steps of:

introducing the auxiliary energy into the safety circuit over a test timeslot;

opening of the safety switch via the test function;

detecting the opening of the safety switch via the detection device;

closing of the safety switch via the test function; and detecting the closing of the safety switch via the detection device.

* * * * *